United States Patent [19]

Zeiske

[11] 3,936,966

[45] Feb. 10, 1976

[54] PERPETUAL CALENDARS

[76] Inventor: Arnold Ernst Zeiske, 6151 Palo Pinto Ave., Dallas, Tex. 75214

[22] Filed: Nov. 18, 1974

[21] Appl. No.: 524,954

[52] U.S. Cl. ..... 40/109; 40/107
[51] Int. Cl.[2] ..... G09D 3/00
[58] Field of Search ..... 40/107, 109, 110–122

[56] References Cited

UNITED STATES PATENTS

| | | | |
|---|---|---|---|
| 429,949 | 6/1890 | Palmersten | 40/115 |
| 1,611,538 | 12/1926 | Landman | 40/109 |
| 3,604,135 | 9/1971 | Robinson | 40/113 |
| 3,792,541 | 2/1974 | Engle | 40/107 |

*Primary Examiner*—John H. Wolff

[57] ABSTRACT

Incorporating for the first time in a perpetual calendar the concept of separating the two digits of the "year," into a single DEACDE digit plus a single YEAR digit, this device determines the calendar for any desired century, decade, year and month whatever, by positioning these calendric time units in combination with each other in successive chain-like liaison, automatically revealing, as a result, the correct calendar desired. It consists of a number of components, each comprising one or more indicia-group-bearing and viewing-area-embracing means or elements (of whatever kind, style or nature), each of which consists either or an indicia-group region and a viewing-area (fenestella, arrow, or the like) region, or of two indicia-group regions. The desired century can, in a given calendar, be displayed in only one way; this determines the only single way in which the desired decade can then be displayed, this positioning, in turn, determining uniquely the spatial setting of the desired year, and so on. Only one such specific designation is displayed at any one time, and it is displayed in full! This unequivocal and unique sequential setting and display and, consequent, automatic calendar revelation are achieved by providing differentially restricted viewing areas, and numerals and month names all correctly positioned with respect to each other on such means, in strict accordance with the hebdomadal sequence patterns fundamental to, and inherent in, the several kinds of time units necessarily involved in the Gregorian (and/or Julian) calendar formulas.

4 Claims, 9 Drawing Figures

PERPETUAL CALENDARS

This invention relates to Calendars, and specifically to perpetual or permanent calendars.

The objects of the present invention are: (1) to provide a calendar which automatically yields the correct calendar for the desired year (or month) when the designation for the desired full 4-digit year (or for the desired full 4-digit year and specific month of that year) is displayed: (2) which REVEALS such full designation; (3) which, at any one time, reveals NO OTHER DESIGNATION (for which the calendar revealed would also be correct); and (4) which makes it possible to show the correct number of days in a month, even unto automatically showing 28 days for common year Februaries and 29 days for Leap Year Februaries, automatically differentiating between century years (those ending in —00) which ARE, are those which are NOT, leap years.

The first principle upon which patentable novelty is predicated is that, whatever means (sliding flat, elongated elements, rotating circular, conical or other elements, separate individual cards or plates, interleaved meshing components tantamount to such individual cards, revolving disks, whether circular or otherwise, etc., etc.) are employed in reducing the invention to practice in any particular physical structural embodiment, the invention itself, as such, resides, in part, upon the SEPARATION OF DECADE AND YEAR DIGITS as INDEPENDENT COMPONENTS OR ELEMENTS, POSITIONABLE INDEPENDENTLY instead of as a 2-digit unit, the designation "1973," for example, being achieved thru THREE settings, instead of TWO: "19" + "7" + "3" instead of "19" plus "73", as is traditionally the manner in which, heretofore, in the prior art, multi-year calendars of the kind described have been designed. This is a fundamental principle. So far as applicant knows no one has ever designed either a single-month, or a full-year, truly perpetual, unequivocal, calendar invoking this concept.

The second basic principle upon which patentable novelty is predicated involves the concept of SUB-CATEGORIZATION. The primary categories into which are divided the means for displaying the indicia representing the various calendric time units, which in themselves, individually, are well known in the art, but which in combination, in the manner delineated, are new, and achieve a new total result in co-operation with each other, are: Century, Decade, Year, Month; and "in-depth" analysis of the anatomy of the calendar, however, reveals that these, in turn, are, from the nature of construction of the calendar formula (which has to be adhered to, to produce meaningful results) subdivided into distinct SUB-CATEGORIES: Julian (J) and Gregorian (G) centuries; Odd (D) and even decades; Leap and Common years; and 28-, 29-, 30-, and 31-day months.

These have to be further broken down into sub-sub-categories: $G_j$ = those Gregorian centuries which have, however, 36,525 days, like the Julian, and $G_g$ those which have only 36,524 days; the even decades have to be split into (E), including zero, and (e) exclusing zero, and zero ($z$) decades; the common years have to (for practical purposes of avoiding double-occupancy of a single space, by, for instance, 3 and 9, etc., after the manner of a 5-rowed calendar resorting to a dodge like 23/30 and 24/31) be divided into $C_1$ and $C_2$ sub-categories; and the 31-day months have to make two sub-categories for January by itself and for the 6 post-February 31-day months, a matter not of arbitrary design but a basic difference in the characteristics of the members of one group with respect to another of a higher (and/or lower) category, subcategory, or sub-sub-category of calendric time units. This introduces the third basic principle upon which patentable novelty is predicated, namely: PATTERNIZATION. The sequence pattern, for instance, of the leap years WITH RESPECT TO THE ODD DECADES is: — — — 6 — 2 — in heptal cycle, whereas with respect to the even decades it is: 0 — — 8 — 4 — (for the pre-March months), but for the post-February months it is, respectively: — 0 — — 8 — 4 vis-a-vis the pre-March months.

"Direction" (i.e., whether 8 4 0 or 0 4 8, etc.,) is irrelevant here, since everything is heptally cyclical and a "grid" or a "shingled" arrangement is not mandatory, nor do the components, elements or other means necessarily have to be in any kind of "alignment" (except as to the conventional alignment of week days and month dates in the calendar itself). So long as internal sequence patternization integrity is maintained, the Julian centuries which are in dense sequence, say 09, 10, 11, 12, 13, 14, 15 ($\pm 7k$, where $k$ is any integer), or 15, 14, 13, 12, 11, 10, 09, ($\pm 7k$) could be arranged in a given embodiment as follows:

| | | | | |
|---|---|---|---|---|
| | 09 | | | 14 |
| | 10 | 12 | | 11 |
| 13 | | | 15 | |

so long as the sequence pattern *abcdefg* is followed for all seven positionings, as in:

| | | | | |
|---|---|---|---|---|
| | a | | | f |
| | b | d | | c |
| e | | | g | |

so that the next arrangement would be:

| | | | | |
|---|---|---|---|---|
| | 10 | | | 15 |
| | 11 | 13 | | 12 |
| 14 | | | 09 | |

and so on.

A fourth basic principle upon which patentable novelty is predicated is: UNIQUENESS OF CONCATENATION. This is best explained by simply listing the necessary and sufficient 84 exhaustive and mutually exclusive PATHS which (in the month calendar) can be "traversed" in the unique successive display of a selective century, decade, year, and month designation, to reveal the exactly correct calendar for that specific designation and nothing else, there being no other way to set this particular designation, and, moreover, there being no other calendar which can be displayed as a result of this specific designation. These "paths" are:

| | | | | |
|---|---|---|---|---|
| J | D | L | Jan. | 29, 30, and 31 |
| | | $C_1$ | " | 28 " |
| | | $C_2$ | " | 28 " |
| | E | L | " | 29 " |
| | | $C_1$ | " | 28 " |
| | | $C_2$ | " | 28 " |
| $G_j$ | D | L | " | 29 " |
| | | $C_1$ | " | 28 " |
| | | $C_2$ | " | 28 " |
| | E | L | " | 29 " |
| | | $C_1$ | " | 28 " |
| | | $C_2$ | " | 28 " |
| $G_u$ | D | L | " | 29 " |
| | | $C_1$ | " | 28 " |
| | | $C_2$ | " | 28 " |
| | e | L | " | 29 " |
| | | $C_1$ | " | 28 " |
| | | $C_2$ | " | 28 " |
| | z | L | " | 29 " |
| | | $C_1$ | " | 28 " |
| | | $C_2$ | " | 28 " |

For the full-year calendar, there would, of course, be only 21 paths.

A fifth basic principle involved in this invention is COMMENSURABILITY. This is not new, being more or less unwittingly recognized in some "perpetual" calendars, but not fully exploited in them. It is the commensurability of a relatively small number of centuries with an exact number of weeks. On the Gregorian basis 4 centuries embrace exactly 20,871 weeks (146,097 days), so that the calendar for any month is exactly the same as that for the same month exactly 400 years earlier or later. On the Julian basis it is 700 years, embracing, of course, 36,525 weeks.

True perpetuality can thus be achieved without listing actually more than four Gregorian centuries, or seven on the Julian basis. Herein the word "century" means the digits and has nothing to do with "The twentieth century," 99 of the years of which naturally use the digits 19 and not 20 at all. Only the last year of a century uses the digits which correspond to the words.

The Twentieth Century ends at midnight Dec. 31, 2000, or, in astronomical nomenclature Jan. 0, 2001. The twenty-first century begins at 00:00:00 Hours on Jan. 1, 2001.

Although there was no Julian CALENDAR, as a continuous instrumentality of fixed formula, before Mar. 1, 0004 A.D., the Julian BASIS can be carried, mathematically, back or forward as far as desired with this calendar. The Gregorian CALENDAR, as such, did not exist until Oct. 15, 1582, but the Gregorian BASIS, the FORMULA, can be applied to any period. Thus from Mar. 1, 200 A.D. thru Feb. 28, 300 A.D. the Julian and Gregorian bases were exactly alike, not only calendar-wise but also as to identify of actual days (J. D. Numbers). From Mar. 1, 1100 thru Feb. 28, 1300, both inclusive, the Julian and Gregorian calendars would have been identical, but the "Julian Day Numbers" would have been 7 days off, since the period: Mar. 1, 1100 thru Feb. 28, 1300 Julian, would correspond day by day to the period: Mar. 8, 1100 thru Mar. 7, 1300 Gregorian. It is to be noted that the year 1 B.C. is NOT the year "minus one" (-1) A.D., but the year "zero"! The years 3 A.D., 2 A.D., 1 A.D., 1 B.C., 2 B.C., 3 B.C., are, mathematically and astronomically, the years, respectively: 3, 2, 1, 0, −1, −2.

The sequence patterns (with hebdomadal periodicity) which are mandatory, are exactly as follows:

CENTURIES: (All ± 28K, where K is any integer)

| | | | | | | | | |
|---|---|---|---|---|---|---|---|---|
| J | 1 | 2 | 3 | 4 | 5 | 6 | 7 | |
| | 8 | 9 | . . . . . | | etc., | | 21 | |
| | 29 | 23 | | 11 | | 49 | | |
| | | | | etc. | | | | all ±7K |
| $G_j$ | — | — | — | — | 12 | — | — | |
| | — | — | — | — | 16 | — | — | |
| | — | — | — | — | 20, | etc. | — | all ± 4K |
| $G_u$ | — | 2 | — | 3 | | — | 5 | |
| | — | 6 | — | 7 | | — | 9 | |
| | | | | etc. | | | | |
| | — | 30 | — | 39 | | — | 29 | |
| | | | | etc. | | | 49 | all ± 4K |

DECADES:

| | | | | | | | | |
|---|---|---|---|---|---|---|---|---|
| D | 1 | 5 | 9 | — | 3 | 7 | — | with respect to J, $G_j$ and $G_u$ |
| E | 4 | 8 | — | 2 | 6 | — | 0 | with respect to J and $G_j$; |
| e | 4 | 8 | — | 2 | 6 | — | — | with respect to $G_u$; |
| z | — | — | — | — | — | — | 0 | with respect to $G_u$. |

YEARS:

| | | | | | | | | |
|---|---|---|---|---|---|---|---|---|
| With respect to D: | | | | | | | | |
| $C_1$: | — | 3 | 4 | — | 0 | 1 | — | |
| $C_2$: | 8 | 9 | — | 5 | — | — | 7 | |
| L : | — | — | — | — | 6 | — | 2 | (For pre-March months) |
| L : | 2 | — | — | — | — | 6 | — | (For post-February months) |
| With respect to E and e: | | | | | | | | |
| $C_1$: | — | — | 1 | 2 | 3 | — | — | |
| $C_2$: | 5 | 6 | 7 | — | — | 9 | — | |
| L : | 0 | — | — | 8 | — | 4 | — | For pre-March months) |
| L : | — | 0 | — | — | 8 | — | 4 | (For post-February months) |
| With respect to z: | | | | | | | | |
| $C_1$: | — | 0 | 1 | 2 | 3 | — | — | |
| $C_2$: | 5 | 6 | 7 | — | — | 9 | — | |
| L : | — | — | — | 8 | — | 4 | — | (For pre-March months) |
| L : | — | — | — | — | 8 | — | 4 | (For post-February months) |

MONTHS:

| | | | | | | | |
|---|---|---|---|---|---|---|---|
| With respect to common years: | | | | | | | |
| Jan: | — | — | — | JAN | — | — | — |
| 28d: | FEB | — | — | — | — | — | — |
| 30d: | NOV | — | — | — | APR | SEP | JUN |
| 31d: | MAR | AUG | MAY | OCT | JUL | DEC | — |
| With respect to leap years: | | | | | | | |
| Jan: | — | — | — | — | JAN | — | — |
| 29d: | — | FEB | — | — | — | — | — |
| 30d: | NOV | — | — | — | APR | SEP | JUN |
| 31d: | MAR | AUG | MAY | OCT | JUL | DEC | — |

The construction and operation of the means which, in combination, produce the new result in the present invention are concurrently explained with respect to references to the Figures of the Drawing.

In the Drawings

BRIEF DESCRIPTION OF THE DRAWINGS

FIGS. 1 thru 5 represent a full single month perpetual calendar of the slide type. FIGS. 1, 2, 3, and 4 are the means by which, respectively, century, decade, year, and month indicia are displayed at viewing areas of FIG. 5, a front face. Alignment of corresponding horizontal levels or rows of FIGS. 1, 2, 3, and 4 with respect to each other and with respect to FIG. 5 is by means of edge-keyed letters, 2. Selected century numeral, 1, of FIG. 1, is displayed at viewing area, 3, of FIG. 5; this positions one and only one of the viewing areas, 4, of FIG. 1 behind window, 5, of FIG. 5. Selected decade digit, 6, of FIG. 2, is then positioned so as to be displayed thru this fenestella, 4, thus positioning one of the fenestellas, 7, at window, 8, of FIG. 5; selected year digit, 9, of FIG. 3, is then positioned so as to be seen thru this fenestella, 7, thereby positioning FIG. 3, so that one of the fenestellas, 10, is seen thru window, 11, of FIG. 5. Lastly, FIG. 4 is positioned so that selected month name, 12, is seen thru this fenestella, 10, thereby positioning seven columns of calendar grid, 13, to be seen thru window, 14, of FIG. 5.

FIGS. 6, 7, 8, and 9 show a front face, 15, and a representative member element from each of the century, decade, and year displaying means of a full-year wall calendar involving, not slides at all, but individual cards or sheets, shown, in this particular embodiment, as being hung and registered with respect to each other, in a fixed positional relationship, by means of eyelets or other means, 32. FIG. 7 represents one of a plurality of cards, having two century designations, 21, 22, for century digits "19" and "21" respectively. FIG. 7 is hung behind FIG. 6, so as to display, thru windows, 16, 17, respectively, the millenium and century digits, as the "century" desired, thereby positioning one of fenestellas, 23 (or 25), on grid, 24 (or 26), as the case might be, to be revealed thru window, 18, of FIG. 6. The desired one of the decade displaying means, two of which are represented by FIG. 8, is then hung behind card of FIG. 7, so as to reveal the desired one of decade digits, 27, thru fenestella, 23, (or 25), previously positioned; this positions fenestella, 29, of grid, 28, within the confines of window, 19, of front face, 15, behind which, so as to reveal, thru fenestella, 29, the desired year digit, 30, is then hung the sheet of FIG. 9, displaying by this means, the correct full 12-month calendar, 31, thru window, 20, of FIG. 6. The location of the single fenestella responsive to, say, the century digits (in this embodiment) consisting, for the sake of uniformity, of a "millenium" digit and a century digit, although operatively regarded simply as the century digits, "19", is located in row 2, column 4 of grid, 24, of FIG. 7, and that corresponding to, or in paired relation with, the century digits "21" is located in row 2, column 5. Similarly every century designation has a unique location in the grid for its fixedly related decade-digit-revealing fenestella. Since the cards are all positioned fixedly (in contradistinction to "slidably" or "rotatively", etc.) with respect to each other, as cards, it follows that the decade digit desired must occupy that particular location in order for it to be seen (displayed), because the digits (in this embodiment) are placed BEHIND the fenestella AFTER same has been positioned. The same procedure holds with regard to the decade digits and their fixedly related fenestellas. In other embodiments the decade digits may be positioned FIRST when the century digits are placed, and the decade fenestella then placed IN FRONT OF the digits, the FENESTELLA being placed AFTER the digits are positioned. Thus that one of the cards, which in one of its areas or regions has the desired decade digit in exactly that location is the only one which can reveal this desired digit. The digits are arranged on the grids in accordance with a prestipulated (logically related) correct sequence pattern, as explained hereinbefore, so that every relevant digit, on one card region or another CAN come precisely into that location. The card of FIG. 8, as can be seen, has on one and the same rectangular grid, TWO "6'"s, for example. The reason is that there is ample room on this grid for two sequence pattern circuits, in this case, namely, one for the even decades (e) responsive to the 36,524-day ($G_g$) century, and another for even decades (E) responsive to the 36,525-day (J and $G_j$) century. The fact that there are two "8'"s and two "6'"s, but only one each of "0'"s, "2'"s and "4'" s on one region, while the other region shown has two "2'"s and two "4'"s, but only one each of "0'"s, "6'"s and "8'"s, arises out of the fact that each numeral must, on one region or another occupy every one of the seven locations constituting a sequence pattern circuit cycle, but there are not seven digits involved, hence, as is clearly seen in the hebodmadal sequence patterns tabulated hereinbefore, there are some vacant spots.

Figure 1:
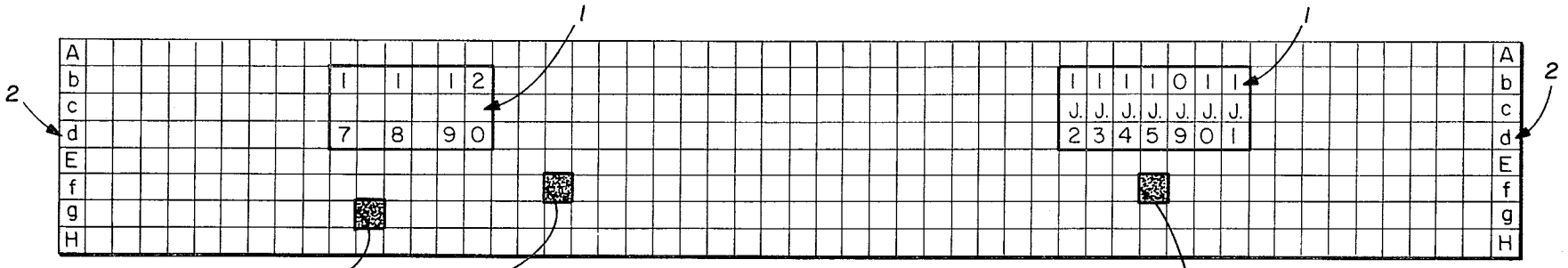
FIG. 1 is a plan view of the century display.
Figure 2:
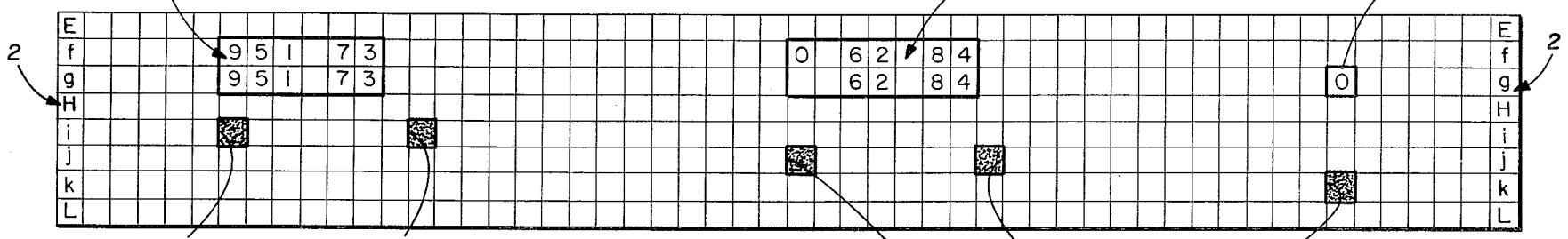
FIG. 2 is a plan view of the decade display.
Figure 4:
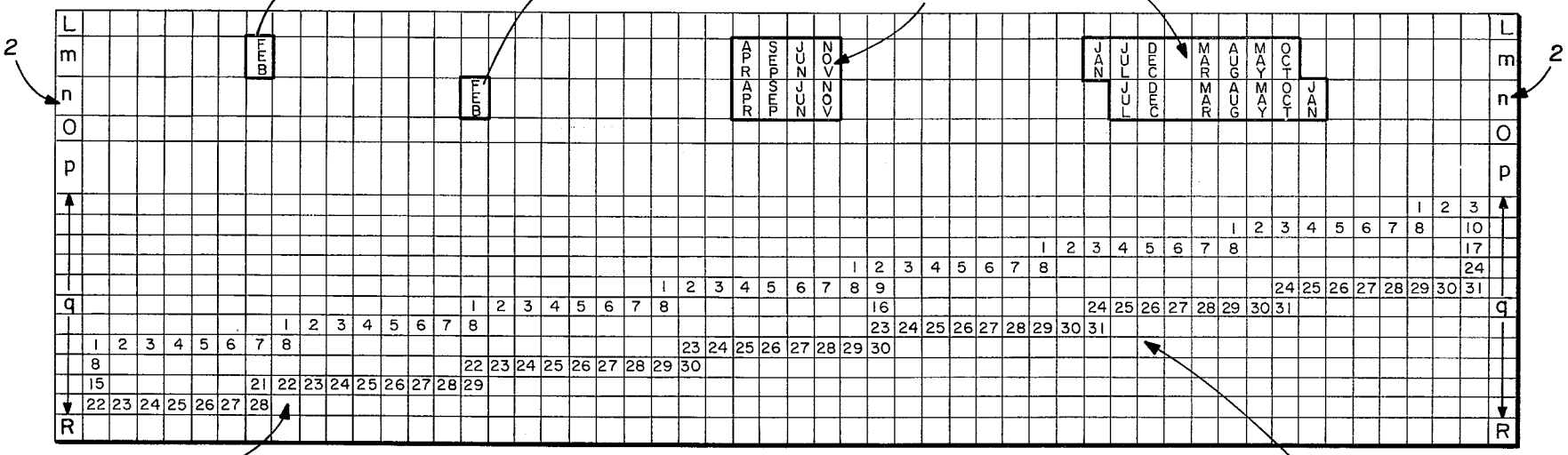
FIG. 4 is a plane view of the month display.
Figure 5:
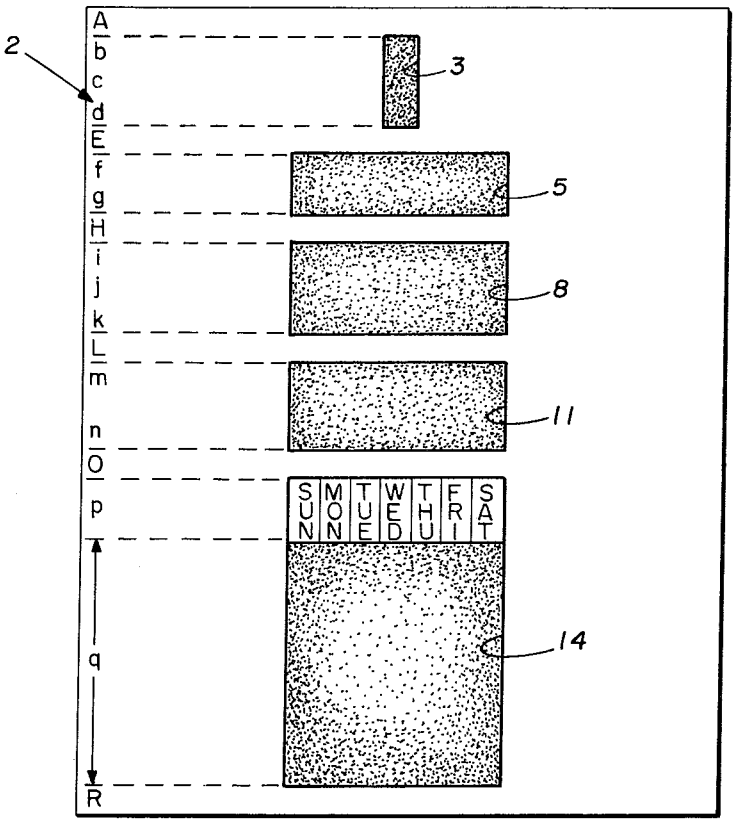
FIG. 5 is a plan view of the calendar display front face.
Figure 3:
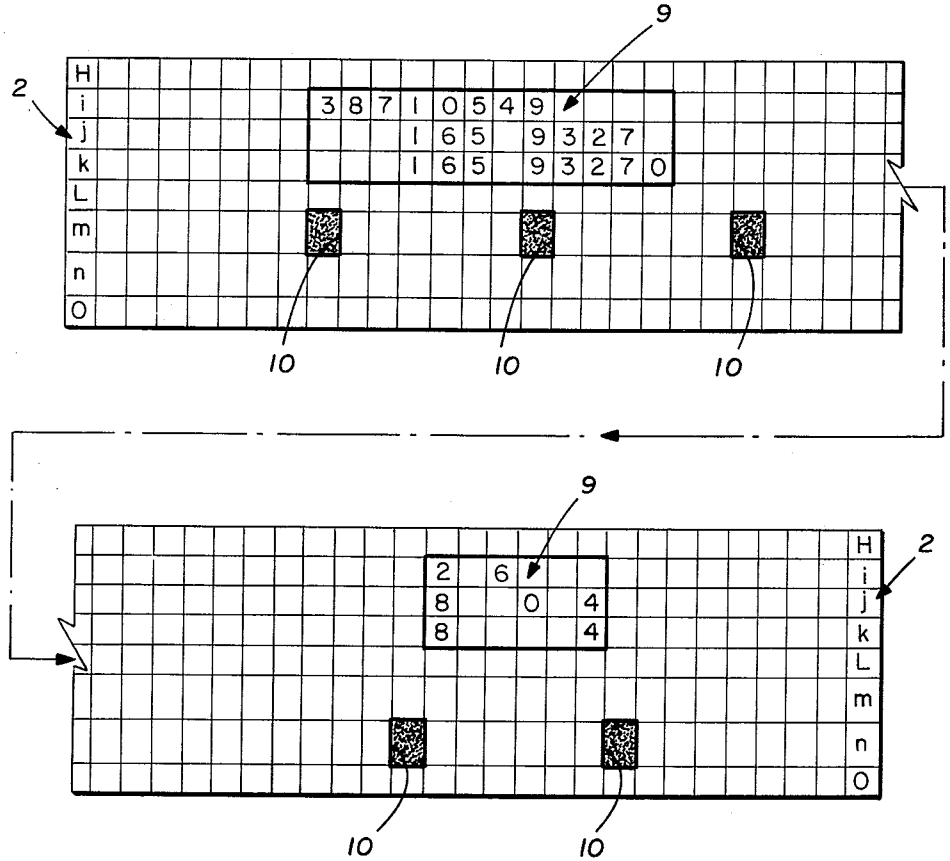
FIG. 3 is a plan view of the year display.
Figure 6:
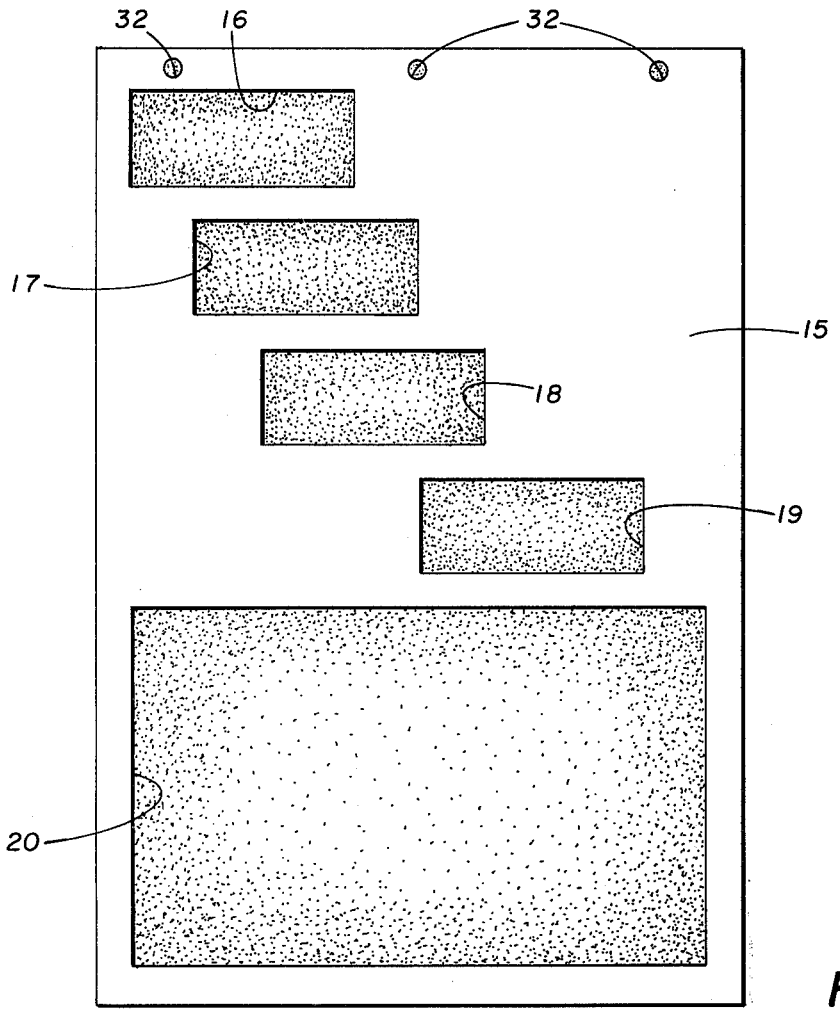
FIG. 6 is a plan view of an alternate calendar display front face.
Figure 7:
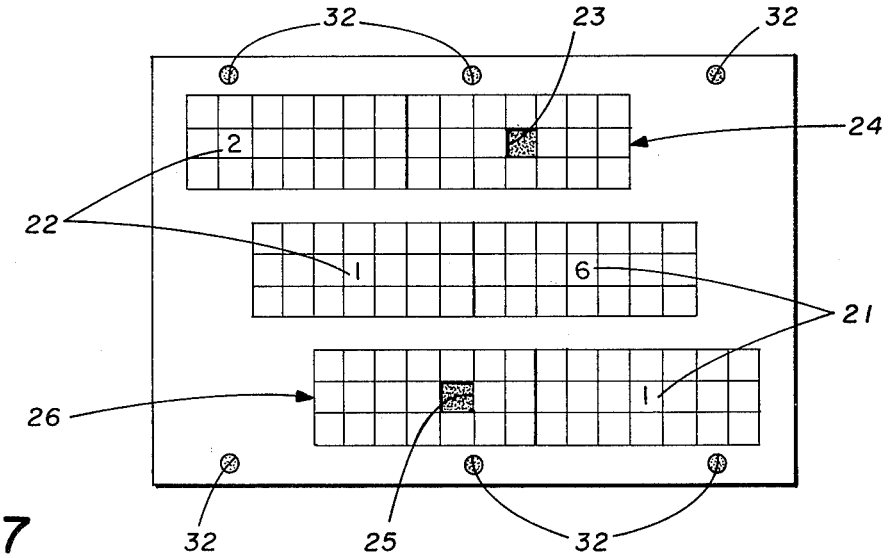
FIG. 7 is a plan view of an alternate century display.
Figure 8:
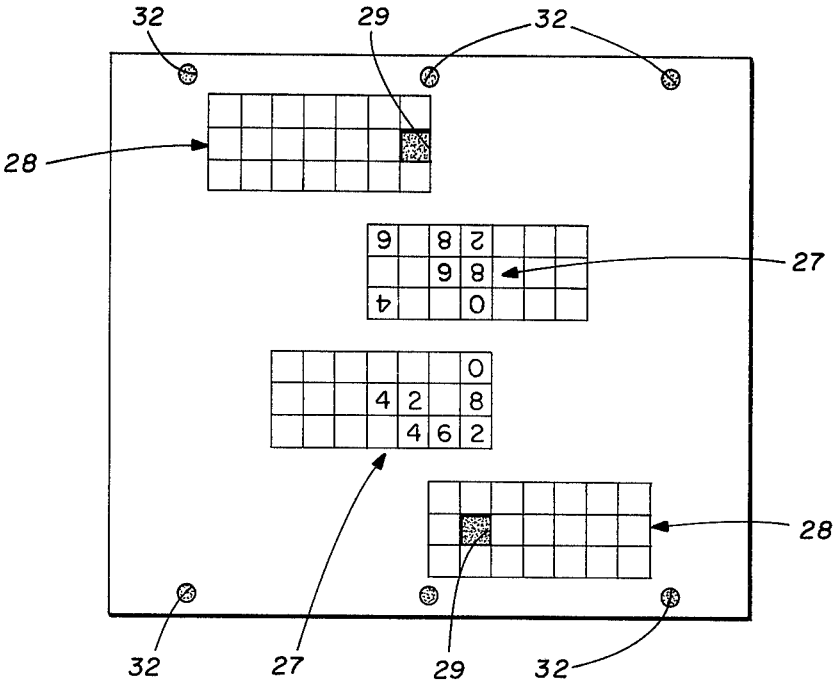
FIG. 8 is a plan view of an alternate decade display.
Figure 9:
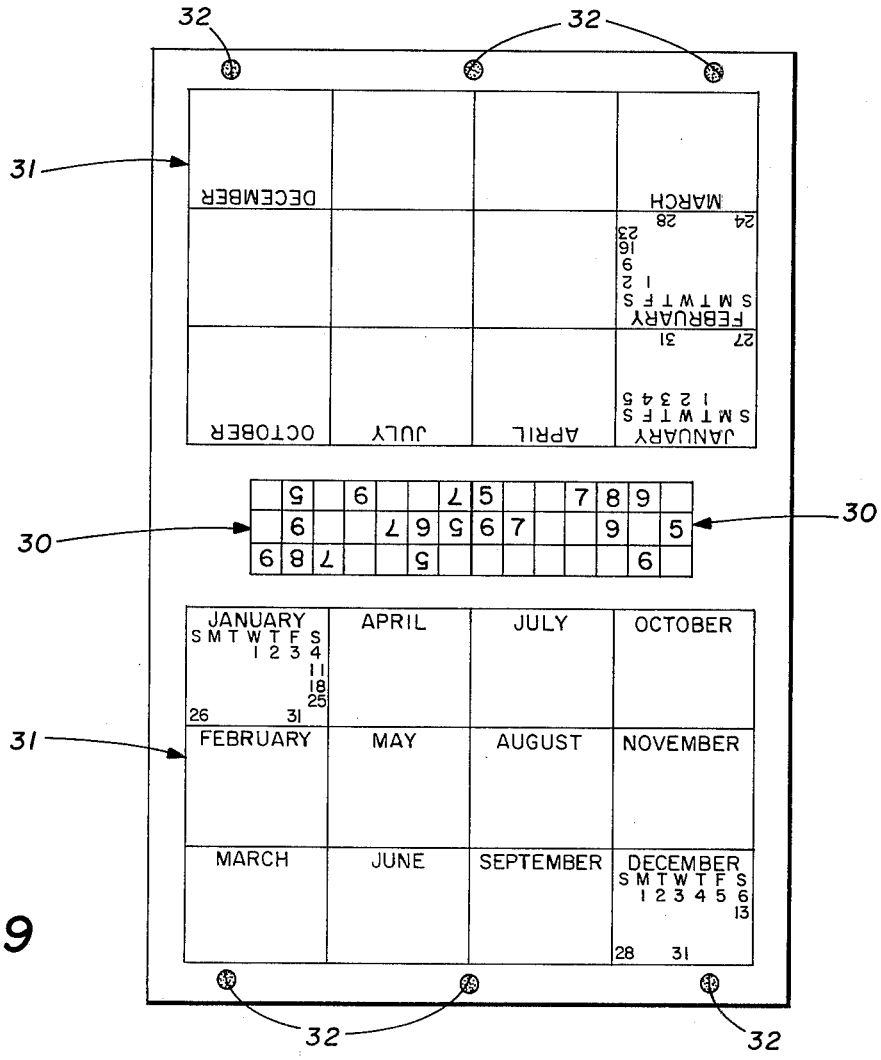
FIG. 9 is a plan view of an alternate year and month display.

In this particular embodiment the entire complement of cards, other than the front face, is as follows, remembering that no more than four regions are available on a single card — two, thru a "work-and-spin" rotation, on each side:

| CATE-GORY | SUB-CATE-GORY | SUB-SUB-CATE-GORY | NUMBER OF REGIONS Avail-able | Used | Blank | NUMBER OF CARDS RE-QUIRED |
|---|---|---|---|---|---|---|
| Century | Julian | J | 8 | 7 | 1 | 2 |
| | | $G_j$ | | 1 | | |
| | Gregorian | | 4 | | 0 | 1 |
| | | $G_g$ | | 3 | | 3 |
| Decade | Odd | D | 8 | 7 | 1 | 2 |
| | | E, e, | 8 | 7 | 1 | 2 |
| | Even | | | | | |
| | | z | 4 | 3 | 1 | 1 |
| | | | | | | 5 |
| Year | Leap | L | 8 | 7 | 1 | 2 |
| | Common | $C_1$ | 8 | 7 | 1 | 2 |
| | | $C_2$ | 8 | 7 | 1 | 2 |
| | | | | | | 6 |
| | | Totals | 56 | 49 | 7 | 14 |

If the Julian Calendar is not involved, there would be only 12 cards.

Having thus divulged and explained my invention in complete detail, both in the Specification and in the Drawings, and both as to the basic principles of combinations which constitute the invention, as such, and as to the construction and operation of two structurally different reduced-to-practice embodiments thereof, I claim:

1. A perpetual calendar comprising, in combination:
means for exhibiting a first viewing area;
means for selectively displaying, at such first viewing area, indicia designating a numeral consisting of at least one digit representative of a century;
means for the positioning, responsively to such selectively displayed century-designating indicia, of a second viewing area;
means for selectively displaying, at such second viewing area, indicia designating a numeral consisting of one digit representative of a decade;
means for the positioning, responsively to such selectively displayed decade-designating indicia, of a third viewing area;
means for selectively displaying, at such third viewing area, indicia designating a numeral consisting of one digit representative of a year;
means for the positioning, responsively to such selectively displayed year-designating indicia, of a fourth viewing area;
means for selectively displaying, at such fourth viewing area, indicia specifying a designation representative of a calendar period of time constituting a part of a year consisting of at least one month;
means for exhibiting a fifth viewing area;
means for resultingly displaying, at such fifth viewing area, and responsively to such selectively displayed partial-year-specifying indicia, indicia constituting, in correlation vis-a-vis the days of the week, the corresponding dates of the calendric period designated by the thus successively, selectively displayed century-representing, decade-representing, year-representing, and partial-year-period-representing indicia.

2. A perpetual calendar comprising, in combination:
means for exhibiting a first viewing area;
means for selectively displaying, at such first viewing area, indicia designating a numeral consisting of at least one digit representative of a century;
means for positioning, responsively to such selectively displayed century-designating indicia, indicia designating a plurality of numerals, each consisting of one digit representative of a decade;
means for positioning a second viewing area so as to display thereat, selective indicia designating a numeral consisting of one digit representative of a decade;
means for positioning, responsively to such second viewing area, indicia designating a plurality of numerals, each consisting of one digit representative of a year;
means for positioning a third viewing area so as to display thereat, selective indicia designating a numeral consisting of one digit representative of a year;
means for positioning, responsively to such third viewing area, indicia specifying a plurality of designations, each representative of a calendric period of time constituting a part of a year consisting of at least one month;
means for positioning a fourth viewing area so as to display thereat, selective indicia specifying at least one designation representative of a calendric period of time of at least one month;
means for exhibiting a fifth viewing area;
means for resultingly displaying, at such fifth viewing area, and responsively to such fourth viewing area, indicia constituting, in correlation vis-a-vis the days of the week, the corresponding dates of the calendric period of time designated by the thus successively, selectively displayed century-representing, decade-representing, year-representing, and partial-year-period-representing indicia.

3. A perpetual calendar comprising, in combination:
means for exhibiting a first viewing area;
means for selectively displaying, at such first viewing area, indicia designating a numeral consisting of at least one digit representative of a century;
means for the positioning, responsively to such selectively displayed century-designating indicia, of a second viewing area;

means for selectively displaying, at such second viewing area, indicia designating a numeral consisting of one digit representative of a decade;

means for the positioning, responsively to such selectively displayed decade-designating indicia, of a third viewing area;

means for selectively displaying, at such third viewing area, indicia designating a numeral consisting of one digit representative of a year;

means for exhibiting a fourth viewing area;

means for resultingly displaying, at such fourth viewing area, and responsively to such selectively displayed year-designating indicia, constituting, in correlation vis-a-vis the days of the week, the corresponding dates of the full year designated by the thus successively, selectively displayed century-representing, decade-representing, and year-representing indicia.

4. A perpetual calendar comprising, in combination:

means for exhibiting a first viewing area;

means for selectively displaying, at such first viewing area, indicia designating a numeral consisting of at least one digit representative of a century;

means for positioning, responsively to such selectively displayed century-designating indicia, indicia designating a plurality of numerals, each consisting of one digit representative of a decade;

means for positioning a second viewing area so as to display thereat, selective indicia designating a numeral consisting of one digit representative of a decade;

means for positioning, responsively to such second viewing area, indicia designating a plurality of numerals, each consisting of one digit representative of a year;

means for positioning a third viewing area so as to display thereat, selective indicia designating a numeral consisting of one digit representative of a year;

means for exhibiting a fourth viewing area;

means for resultingly displaying, at such fourth viewing area, and responsive to such third viewing area, constituting, in correlation vis-a-vis the days of the week, the corresponding dates of the full year designated by the thus successively, selectively displayed century-representing, decade-representing, and year-representing indicia.

* * * * *

UNITED STATES PATENT OFFICE

CERTIFICATE OF CORRECTION

Patent No. 3,936,966 Dated February 10, 1976

Inventor(s) Arnold Ernst Zeiske

It is certified that error appears in the above-identified patent and that said Letters Patent are hereby corrected as shown below:

On the Cover Sheet,
UNDER ABSTRACT:

line 13, "of" should read -- or --.

Column 1, line 51, "and" should read -- an --.

Column 3, tabulation at top, lines 1 through 15, "and" and the "31" should be dittoed.

Column 4, line 19, "as to identify" should read -- as to identity --.

Columns 3 and 4, under CENTURIES J, the third line under "6", "49" should be deleted, and under the "7" -- 49 -- should be inserted.

Column 10, lines 19 through 24, Claim 4, should read as follows:

-- ing area, and responsively to such third viewing area, indicia constituting, in correlation vis-a-vis the days of the week, the corresponding dates of the full year designated by the thus successively, selectively displayed century-representing, decade-representing, and year-representing indicia. --.

Signed and Sealed this twentieth Day of April 1976

[SEAL]

Attest:

RUTH C. MASON
Attesting Officer

C. MARSHALL DANN
Commissioner of Patents and Trademarks